US009637999B2

(12) United States Patent
Garcia et al.

(10) Patent No.: US 9,637,999 B2
(45) Date of Patent: May 2, 2017

(54) ISOLATION PACKER WITH AUTOMATICALLY CLOSING ALTERNATE PATH PASSAGES

(71) Applicants: Andres Garcia, Rosenberg, TX (US); Nervy E. Faria, Houston, TX (US); Britain Fisher, Houston, TX (US); Christophe Malbrel, Houston, TX (US); Vasily Eliseev, Richmond, TX (US); Michael Ma, Houston, TX (US)

(72) Inventors: Andres Garcia, Rosenberg, TX (US); Nervy E. Faria, Houston, TX (US); Britain Fisher, Houston, TX (US); Christophe Malbrel, Houston, TX (US); Vasily Eliseev, Richmond, TX (US); Michael Ma, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 235 days.

(21) Appl. No.: 14/479,687

(22) Filed: Sep. 8, 2014

(65) Prior Publication Data

US 2015/0267518 A1 Sep. 24, 2015

Related U.S. Application Data

(63) Continuation-in-part of application No. 14/218,460, filed on Mar. 18, 2014.

(51) Int. Cl.
*E21B 43/04* (2006.01)
*E21B 34/06* (2006.01)
(Continued)

(52) U.S. Cl.
CPC ..... *E21B 34/06* (2013.01); *E21B 17/18* (2013.01); *E21B 33/1208* (2013.01); *E21B 43/04* (2013.01)

(58) Field of Classification Search
CPC ..... E21B 43/04; E21B 43/02; E21B 43/08
See application file for complete search history.

(56) References Cited

U.S. PATENT DOCUMENTS 6,298,916 B1 10/2001 Tibbles et al.
6,464,007 B1 10/2002 Jones
(Continued)

FOREIGN PATENT DOCUMENTS

WO 2011060495 A1 5/2011

OTHER PUBLICATIONS

Baker Hughes, "Equalizer/MPas Mitigated Fractures in Optimized Completion in Horizontal Well: Baker Hughes Increases Flow Production for Reservoir in Middle East Operation", 1 page, retrieved Jan. 1, 2016, retrieved from the Internet http://assets.cmp.bh.mxmcloud.com/system/b43a11d27baa2860d83d3cdf5b124d-6a_27937-equalizer-mpas_casehistory-0310.pdf.
(Continued)

*Primary Examiner* — Robert E Fuller
(74) *Attorney, Agent, or Firm* — Cantor Colburn LLP

(57) ABSTRACT

An isolation method is described for gravel packed zones separated by at least one packer and having an auxiliary conduit passing through the packer into adjacent zones. The conduit includes at least one each of a shunt tube, flow housing, annular space, and isolation valve housing. The flow housing, the annular space, and the isolation valve housing are all annular and formed between two concentric pipes. The method includes running in an assembly of screens isolated by at least one packer with at least one auxiliary conduit extending into adjacent zones defined by the packer when the packer is subsequently set. The method also includes closing flow in said conduit to prevent flow into shunt tubes during production based on creating a flow
(Continued)

barrier in the annular space, the flow housing, or the isolation valve housing, the shunt tubes supplying slurry through the auxiliary conduit prior to the production.

9 Claims, 7 Drawing Sheets

(51) Int. Cl.
*E21B 33/12* (2006.01)
*E21B 17/18* (2006.01)

(56) References Cited

U.S. PATENT DOCUMENTS 6,588,506 B2 7/2003 Jones
7,126,160 B2 10/2006 Sun et al.
7,128,152 B2 10/2006 Anyan et al.
7,147,054 B2 12/2006 Wang et al.
7,296,624 B2 11/2007 Rodet et al.
7,373,979 B2 5/2008 Coronado et al.
7,407,007 B2 8/2008 Tibbles
7,562,709 B2 7/2009 Saebi et al.
7,784,532 B2 8/2010 Sevre et al.
7,841,398 B2 11/2010 Tibbles et al.
8,403,062 B2 3/2013 Dale et al.
8,453,734 B2 6/2013 Jasek et al.
8,701,765 B2 4/2014 Jasek et al.
2007/0246213 A1* 10/2007 Hailey, Jr. ..... E21B 43/08 166/278
2010/0096119 A1 4/2010 Sevre et al.
2012/0055667 A1* 3/2012 Ingram ..... E21B 33/1208 166/65.1
2012/0227986 A1 9/2012 Sevre
2013/0020088 A1* 1/2013 Dyer ..... E21B 34/063 166/373
2013/0284445 A1 10/2013 Hughes
2014/0027115 A1 1/2014 Sanders
2015/0267517 A1 9/2015 Garcia et al.

OTHER PUBLICATIONS

International Search Report and Written Opinion for PCT Application No. PCT/US2015/016282, dated May 19, 2015, pp. 1-10.

* cited by examiner

ISOLATION PACKER WITH AUTOMATICALLY CLOSING ALTERNATE PATH PASSAGES

CROSS REFERENCE TO RELATED APPLICATIONS

This application claims the benefit of an earlier filing date from U.S. application Ser. No. 14/218,460 filed Mar. 18, 2014, the entire disclosure of which is incorporated herein by reference.

FIELD OF THE INVENTION

The field of the invention is zonal isolation across a set packer that has alternate path passages that go through its body or seal and more particularly where such closures are automatically actuated.

BACKGROUND OF THE INVENTION

In the context of multiple zone isolation when gravel packing while using alternative path conduits there is a need to be able to isolate the zones on opposed sides of a set packer in open or cased hole. In doing so there is a need to seal off the alternate paths that run through the packer bodies or seals. One approach that has been tried is to introduce fluid in the wellbore that initiates a swelling response in a material that seals off the alternate paths. This approach is described in U.S. Pat. No. 7,407,007. The problem in this design is that it requires delivery to the swelling material of a fluid that will induce it to swell. The problem is that there is uncertainty if the delivered fluid has actually reached the swelling material in the individual tubes to start the process. Further, there is also a time delay issue from the onset of the circulation to the obtaining the desired result of path isolation. A variation of this design using a shifting tool to operate a valve in an auxiliary conduit is U.S. Pat. No. 7,562,709.

Also of general interest to the field of auxiliary conduits and closures associated with isolation devices or such conduits are the following: U.S. Pat. Nos. 7,126,160; 7,373,979; 7,296,624; 7,128,152; 7,784,532; 7,147,054; 6,464,007; 8,403,062; 6,588,506; 8,453,734 and 7,841,398.

SUMMARY OF THE INVENTION

According to an embodiment, an isolation method for gravel packed zones separated by at least one packer and having at least one auxiliary conduit passing through said packer into adjacent zones, the conduit comprising at least one each of a shunt tube, flow housing, annular space, and isolation valve housing, and the flow housing, the annular space, and the isolation valve housing all being annular and being formed between two concentric pipes includes running in an assembly of screens isolated by at least one packer with at least one auxiliary conduit extending into adjacent zones defined by said packer when said packer is subsequently set; and closing flow in said conduit to prevent flow into shunt tubes during production based on creating a flow barrier in the annular space, the flow housing, or the isolation valve housing, the shunt tubes supplying slurry through the auxiliary conduit prior to the production.

Auxiliary conduits that run through a packer body or seal are equipped with thermally responsive valve members that with a time exposure close off the conduits to create zonal isolation across one or more packers after a gravel pack. The heat source can also be added to the well fluids to control the speed of the process either in the form of heaters or reactive chemicals that create an exothermic reaction or by other means. The valve material can be shape memory polymer.

DETAILED DESCRIPTION OF THE PREFERRED EMBODIMENT

As noted above, there is a need to achieve zonal isolation within a gravel pack screen. In particular, an alternate path or shunt tube channels flow through a flow housing to an annular space (cross-coupling annulus). Efforts to prevent flow back up the borehole (up the shunt tubes that deliver the slurry for the gravel pack screen) during production have focused on the shunt tubes themselves. In contrast to above-noted current approaches that relate to tubes or flow paths within an annulus, embodiments described herein address closing off the cross-coupling annulus or the flow housing, as detailed below. The purpose of closing off the annulus or flow housing is to prevent water or other material from being pumped up the shunt tubes after the shunt tubes have delivered slurry (down the borehole) for the gravel pack during the completion phase. One particular embodiment is discussed with reference to FIGS. 1 and 2.

Figure 1:
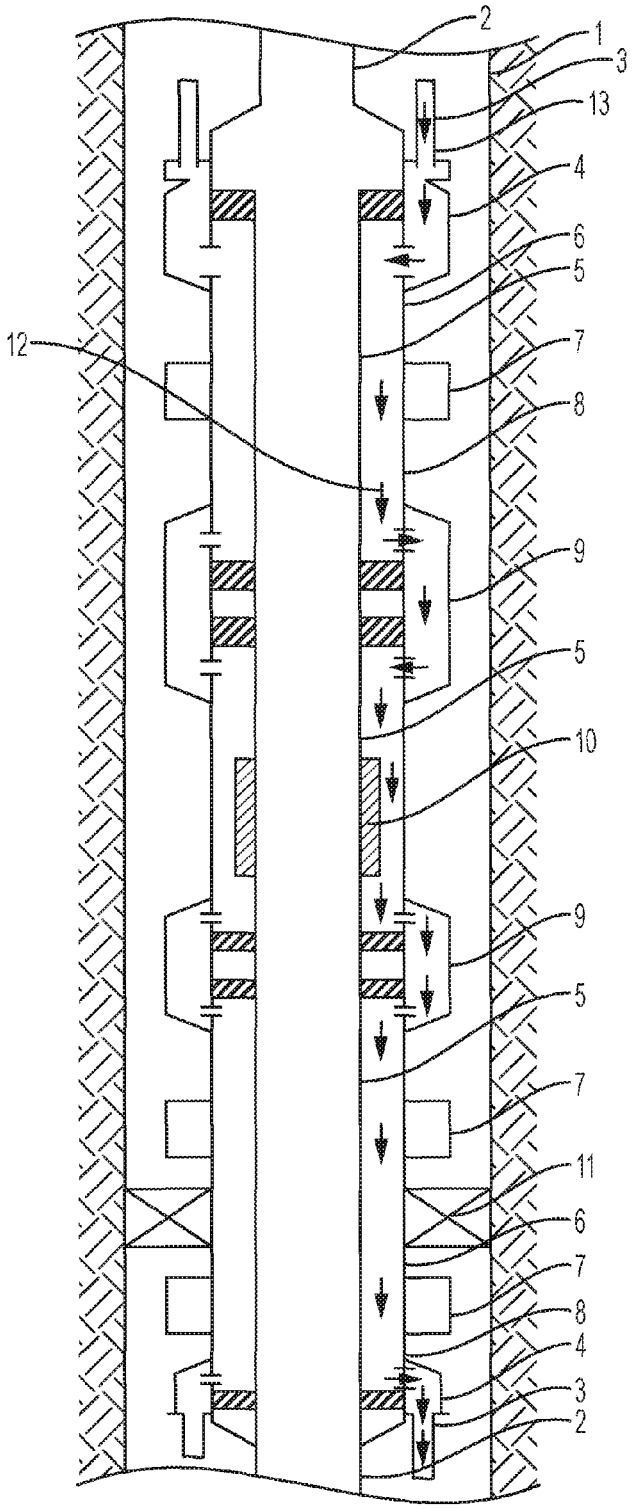
FIG. 1 is a schematic representation of a gravel packing assembly showing the auxiliary conduit with the closure in the conduit in the open position for multizone gravel packing.
Figure 2:
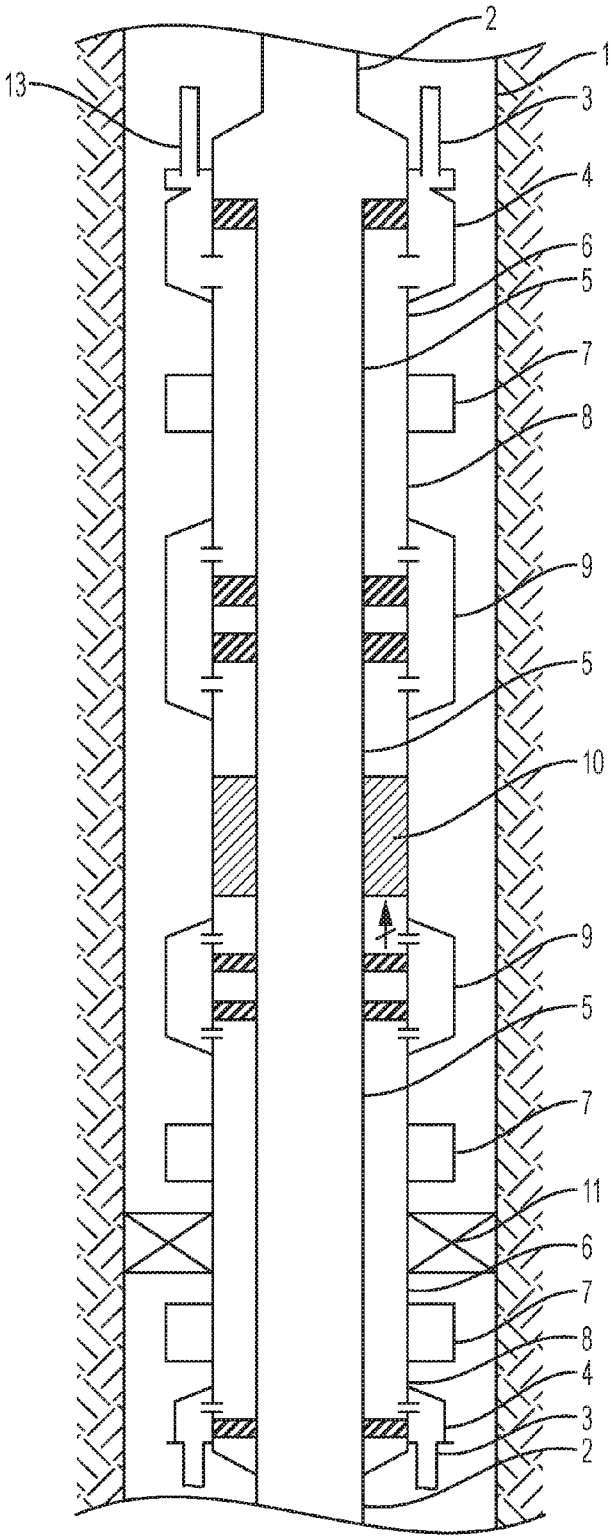
FIG. 2 is the view of FIG. 1 with the valve in the conduit in the closed position after the gravel packing so that adjacent zones are isolated for production.

FIG. 1 shows an open hole 1 that has a screen base pipe 2 that supports one or more isolation packers 11 that separate producing zones, although only a single zone is fully illustrated. Portions of an adjacent zone can be seen in the form of communication housing 4 that appears above and below the packer 11 and thus is shown extending into multiple zones. The base pipes 2 are connected with couplings 7 and communications mandrels 5 to make a continuous string that supports the screens that are not shown. Auxiliary conduits 3 include the shunt tube 13 (also referred to as the alternate path), flow housing 4, isolation valve housing 9, and the annular space 12. The flow housing 4, isolation valve housing 9, and annular space 12 are all annular spaces between two concentric elements. During slurry flow, the flow housing 4 (shown on the left side at the start of the illustrated flow) is essentially a common chamber into which a number (e.g., four) shunt tubes 13 flow slurry. This slurry is channeled into the annular space 12 and into the isolation valve housing 9 then back out to the flow housing 4 (shown on the right side at the end of the illustrated flow) into a number of shunt tubes 13 again. The tubes into and out of the flow housing 4 are held in the annulus between two perforated tubes. The two concentric elements that form the boundaries of the annular space 12, as shown in FIG. 1, are the communications mandrel 5 (in the base pipe 2) and one of the bottom sub 6, coupling 7, or top sub 8. The auxiliary conduits 3 extend through either the body or seal of the packers 11 with the flow through the packer 11 illustrated with a series of arrows. In each conduit 3 there is a valve member 10 (shown in the annular space 12) that during running in leaves each conduit 3 open to pass gravel between zones on opposed sides of each packer 11. The member 10 is preferably a high temperature shape memory polymer that responds to temperatures of the surrounding well fluid to cross its transition temperature and change shape into the FIG. 2 shape where the conduits 3 are obstructed. The heat can come from well fluid temperatures that occur naturally or the temperature can be artificially enhanced with heat from a heater or from an induced reaction that is exothermic or from other heat sources brought into the vicinity of the member 10. The artificial addition of heat just brings the member 10 to its critical temperature faster for closing off the annular space 12 of the conduits 3 on one or opposed sides of a packer 11 for full zonal isolation when the packer 11 is set. In alternate embodiments, the member 10 may be in the flow housing 4 or in the isolation valve housing 9 rather than in the annular space 12. The packers 11 can be unset during gravel packing so that multiple zones can be gravel packed together followed by setting the packers 11 followed by using the heat in well fluid to automatically shut the annular space 12 of the conduits 3 for full zonal isolation. FIG. 1 shows various components such as communication housing 4, top sub 8, isolation valve housing 9 and bottom sub 6 all of which are part of the conduits 3 that overly the base pipe 2 and associated screens that are not shown that overly the base pipes 2. Member 10 is shown as a valve member inside the conduit 3 that with a crossing of the transition temperature closes it. Alternatively the conduit 3 itself can be made from a similar material so that the crossing of the critical temperature from well fluid makes the shape change that ensues change the tubular wall configuration and creates a closure for zonal isolation to become effective at the packers 11 because the conduits that span the set packer are effectively closed. The members 10 in each zone can be responsive to the same or different well fluid temperatures so that closure of members 10 in adjacent zones can occur at the same or different times. This allows sequential closures of the conduits 3 in an uphole or downhole sequence or in another desired sequence. Adding heat locally can also control the order of closures. It should be noted that the flow housings 4 allow entry or exit of gravel into the surrounding annulus for the gravel packing.

The advantage of the present invention is the automatic operation of the closures in the annular space 12 of the conduits 3 (or the isolation valve housing 9 or flow housing 4) that then make possible the zonal isolation at the packers 11 to allow selective production or injection into selected zones or full isolation of such zones if desired. With proper screen valves individual zones can be separately produced or multiple zones can be produced together. The closures can be situated anywhere in the annular space 12 of the conduits 3 between isolation packers 11 with preferably each conduit 3 having one or more members in a given packer 11 interval with the use of multiple members providing further assurance that there is tight closure in the conduits between the zones. Apart from a shape change that plugs the conduits 3 the shape of the conduits 3 can changes when the shape memory polymer is used for the conduit wall itself and reverts to a shape above the critical temperature that effectively closes the conduit. The member material can be shape memory alloy in an alternative design. The automatic operation of the closures for the conduits 3 can save time in getting the isolation of zones accomplished so that the next phase can be started that much faster. In the event additional time is needed before the conduits 3 close, fluid can be circulated with the gravel that is refrigerated to temporarily suspend the closure to allow time for effective completion of the gravel packing.

Figure 3:
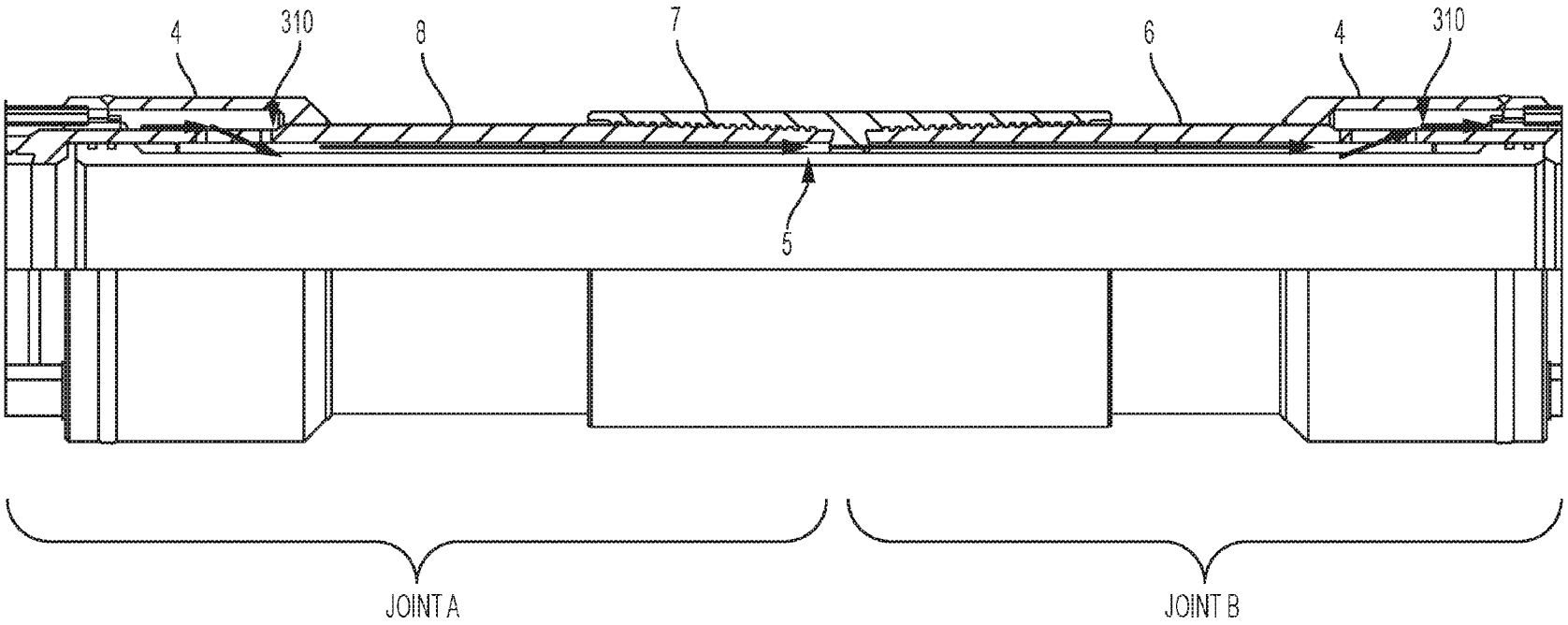
FIG. 3 further details portions of the conduit in which flow is interrupted according to embodiments of the invention.

FIG. 3 further details portions of the conduit 3 in which flow is interrupted according to embodiments of the invention. As noted above, the annular space 12 is the space between two concentric elements. The inner concentric element that defines the inner boundary of the annular space 12 is the base pipe 2 or, more specifically, the communication mandrel 5 portion (as shown in FIG. 3), and the outer concentric element that defines the outer boundary of the annular space 12 is the bottom sub 6, the coupling 7, or the top sub 8 (at the different axial locations shown in the figures). Perforations 310 shown in the bottom sub 6 and top sub 8 facilitate the flow of fluid between the flow housing 4 (or the isolation valve housing 9, not shown in FIG. 3) and the annular space 12. Each of the embodiments discussed herein relates to closing off the annular space 12, the isolation valve housing 9, or the flow housing 4 of the conduit 3 to create zonal isolation. As discussed above, a member 10 (e.g., shape memory polymer) located in the annular space 12 (or in the flow housing 4) closes based on temperature.

Figure 4B:
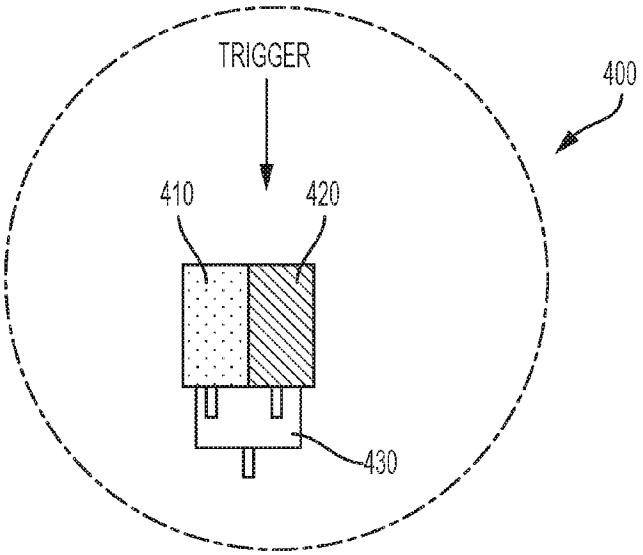
FIGS. 4A and 4B illustrate an embodiment for closing the annular space, isolation valve housing, or flow housing using an injection device.
Figure 4A:
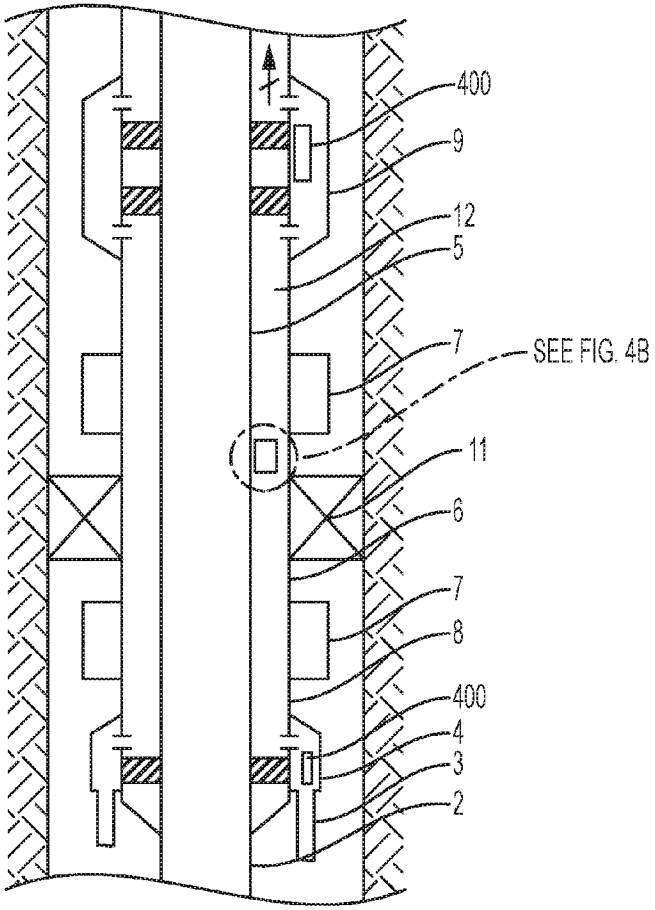

FIG. 4 illustrates an embodiment for closing the annular space 12, isolation valve housing 9, or flow housing 4 using an injection device 400. According to the embodiment shown in FIG. 4, the injection device 400 includes a container of resin 410 and a container of curing agent 420. The containers stay separated until a trigger signal is issued. The resin 410 may be an epoxy resin, for example. The trigger may be in the form of a hydrostatic pulse or other signal. Once the trigger is issued, the resin 410 and agent 420 mix in a chamber 430 of the injection device 400. The mixture (as the mixing is taking place) then invades the annular space 12. There may be a number (e.g., 3 to 5) of injection devices 400 arranged circumferentially around the annular space 12 such that the mixture exiting each injection device 400 forms a gas tight seal in the annular space 12. The containers for the resin 410 and curing agent 420 need not be kept together as shown but, instead, may be separated and located on the same joint as the packer 11. Further, the chamber 430 may not be present such that the mixing takes place in the annular space 12. In an alternate embodiment, as also shown in FIG. 4, the injection device 400 may be disposed in the flow housing 4 or in the isolation valve housing 9 rather than in the annular space 12. Specifically, multiple injection devices 400 may be disposed circumferentially around the flow housing 4 or the isolation valve housing 9 to close off the flow housing 4 or isolation valve housing 9 based on a trigger that causes the resin 410 and curing agent 420 to mix.

Figure 5B:
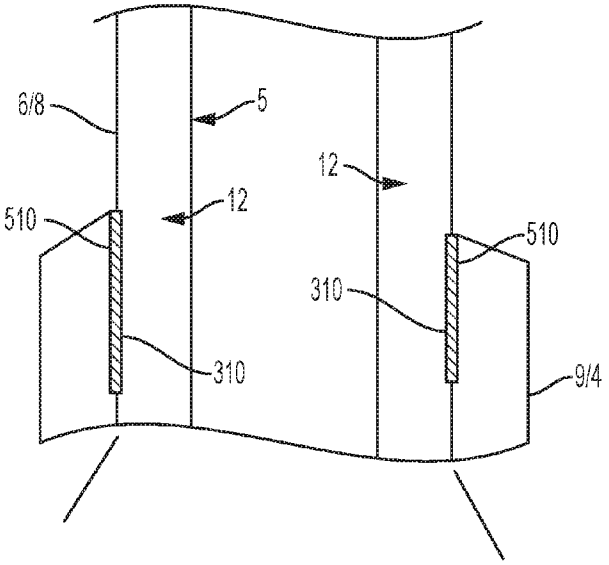
FIGS. 5A and 5B illustrate an embodiment for closing the conduit at the flow housing or isolation valve housing using a rubber sleeve.
Figure 5B:
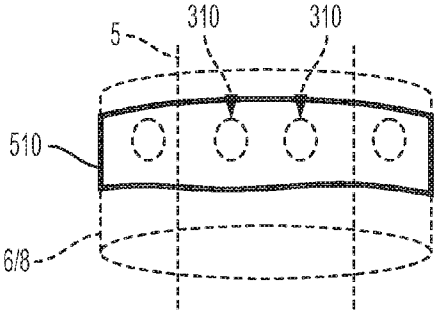
Figure 5A:
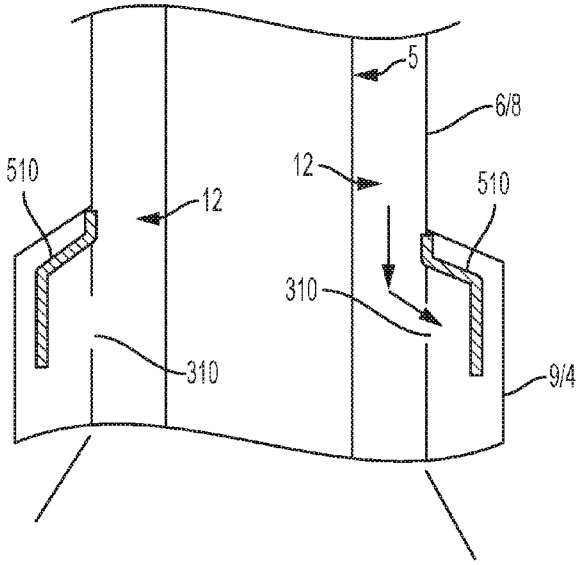
Figure 5A:
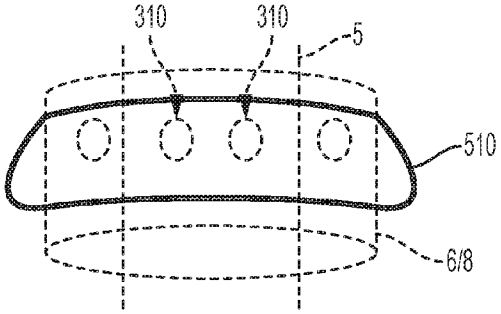

FIGS. 5A and 5B illustrate an embodiment for closing the conduit 3 at the flow housing 4 or isolation valve housing 9 using a rubber sleeve 510. The rubber sleeve 510 is positioned at the perforations 310 on the bottom sub 6 or top sub 8, as shown. As shown in FIG. 5A, the rubber sleeve 510 is pushed (balloons) open based on fluid pressure of fluid flowing from the annular space 12 through the perforations 310 into the flow housing 4 or isolation valve housing 9. This would be the case when slurry is flowing downhole prior to production, for example. As shown in FIG. 5B, when fluid flow in the annular space 12 is not forcing the rubber sleeve 510 into the open position, the rubber sleeve 510 stays against the perforations 310 and prevents flow from the flow housing 4 or isolation valve housing 9 into the annular space 12. As such, during production, water is prevented from going back uphole through the annular space 12 and ultimately into the shunt tubes 13. Specifically, flow is prevented from the flow housing 4 into the annular space 12 between the bottom sub 6 and communication mandrel 5 or from the isolation valve housing 9 into the annular space 12 between the top sub 8 and communication mandrel 5. In alternate embodiments, a sleeve made of a material other than rubber that expands to uncover the perforations 310 based on fluid pressure from fluid in the annular space 12 may be used. While one set of perforations 310 (at one axial location of the flow housing 4 or isolation valve housing 9) is shown, the rubber sleeve 510 or other sleeve may cover multiple sets (rows) of perforations 310.

Figure 6B:
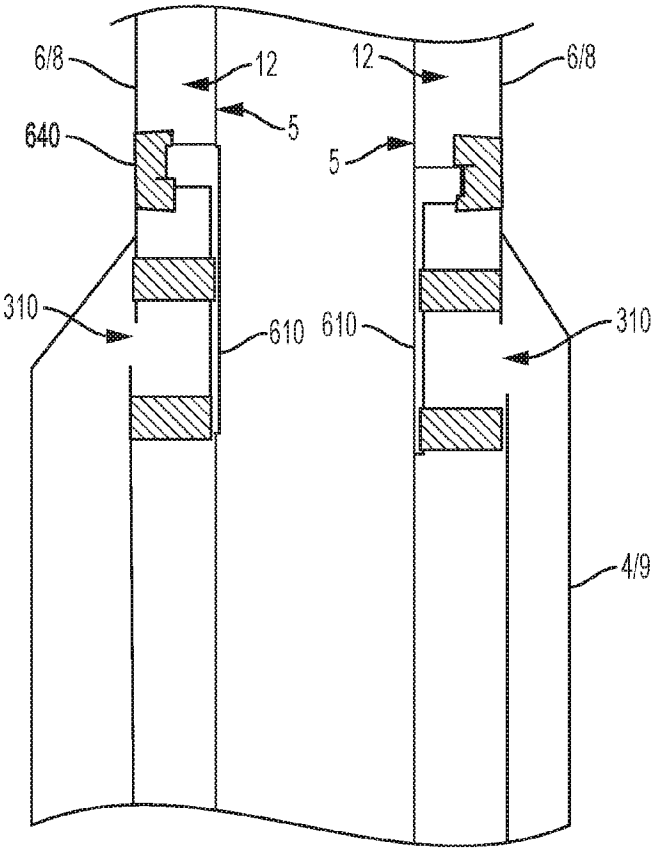
FIGS. 6A and 6B illustrate an embodiment for closing the conduit at the flow housing or isolation valve housing using a sliding sleeve.
Figure 6A:
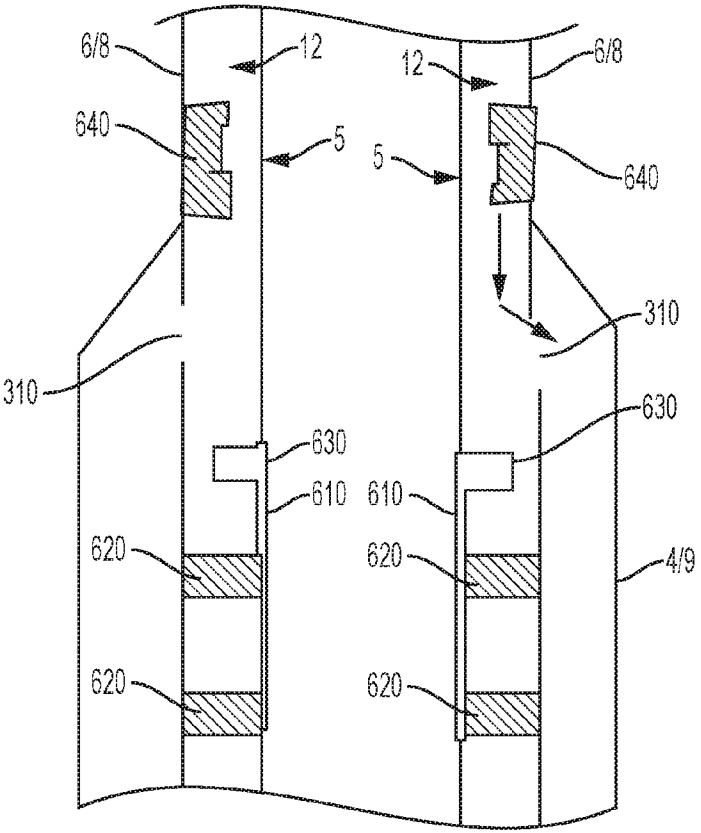

FIGS. 6A and 6B illustrate an embodiment for closing the conduit 3 at the flow housing 4 or isolation valve housing 9 using a sliding sleeve 610. Two different embodiments of a sliding sleeve 610 are discussed. The sliding sleeve 610 includes a pair of seals 620 associated with each perforation 310 in the bottom sub 6 or top sub 8. FIG. 6A illustrates an open position in which both seals 620 of the sliding sleeve 610 are below the corresponding perforation 310 such that downhole flow of slurry, for example, is not obstructed. That is, slurry may freely flow through the annular space 12 between the communication mandrel 5 and bottom sub 6 through to the flow housing 4 or through the annular space 12 between the communication mandrel 5 and top sub 8 through to the isolation valve housing 9. FIG. 6B illustrates a closed position in which each pair of seals 620 are on either side of each corresponding perforation 310 such that flow from the flow housing 4 into the annular space 12 or flow from the isolation valve housing 9 into the annular space 12 is prevented. According to one embodiment, the sliding sleeve 610 slides along the outer surface of the communication mandrel 5 while, according to another embodiment, the sliding sleeve 610 is a portion of the communication mandrel 5 itself. That is, a portion of the outer surface of the communication mandrel includes seals 620. The sliding sleeve 610 may lock into place based on a mating of the sleeve portion 630 with the annular portion 640 locking mechanism that is disposed (attached) within the annular space 12.

The sliding sleeve 610 (whether stand-alone or part of the communication mandrel 5) may slide into the position to close off the perforations 310 based on a number of mechanisms. According to one embodiment, a dissolvable nano material may hold the sliding sleeve 610 in the open position shown in FIG. 6A. As long as the nano material is selected so that it does not dissolve too quickly (within hours), at a time at or nearing the end of the completion process (prior to start of production), the sliding sleeve 620 will be released to the closed position shown in FIG. 6B. According to another embodiment, a trigger may be used to move the sliding sleeve 610 from the open to the closed position. For example, a washpipe (used until the end of the completion phase) is typically pulled up prior to production. Thus, the washpipe may be outfitted with a magnet or electrical signal source such that, as the washpipe passes the sliding sleeve 610 on its way out of the borehole, the sliding sleeve 610 is triggered to move to the closed position (FIG. 6B) prior to production. In alternate embodiments, the sliding sleeve 610 may be mechanically or hydraulically actuated.

Figure 7B:
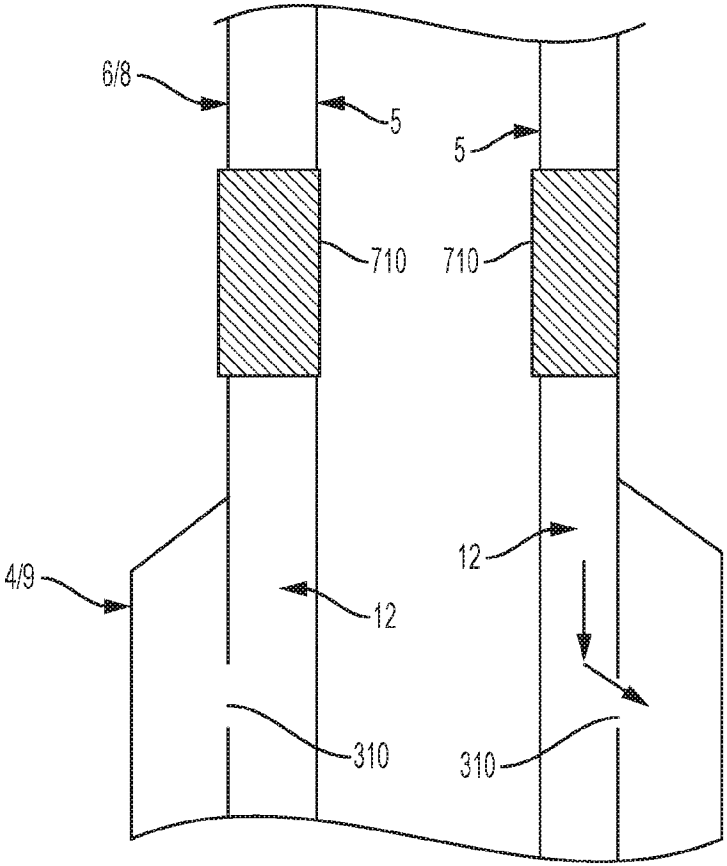
FIGS. 7A and 7B illustrate an embodiment for closing the conduit at the annular space using an inflatable packer within the communication mandrel.
Figure 7A:
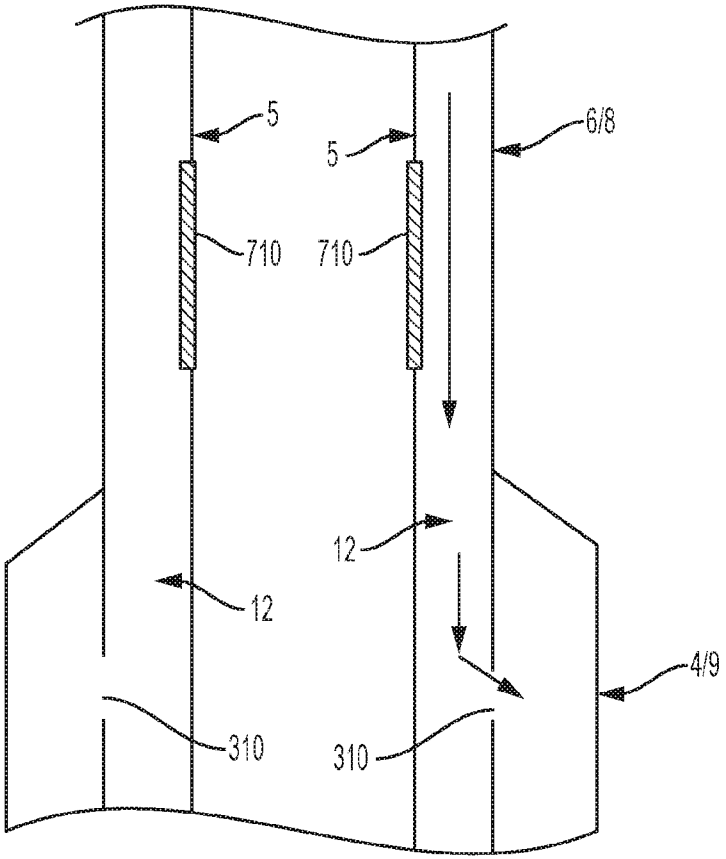

FIGS. 7A and 7B illustrate an embodiment for closing the conduit 3 at the annular space 12 using an inflatable packer 710 within the communication mandrel 5. A portion of the communication mandrel 5 is comprised of an inflatable material (inflatable packer 710). In the open position, shown in FIG. 7A, the inflatable packer 710 is not inflated and slurry flows through the annular space 12 into the flow housing 4 or isolation valve housing 9. When the inflatable packer 710 within the communication mandrel 5 is inflated, as shown in FIG. 7B, flow through the portion of the annular space 12 that is taken up by the inflated inflatable packer 710 is closed off. The inflatable packer 710 may be inflated prior to the start of the production phase based on hydraulic pressure, for example, or another mechanism.

The above description is illustrative of the preferred embodiment and many modifications may be made by those skilled in the art without departing from the invention whose scope is to be determined from the literal and equivalent scope of the claims below:

We claim:

1. An isolation method for gravel packed zones separated by at least one packer and having at least one auxiliary conduit passing through said packer into adjacent zones, the conduit comprising at least one each of a shunt tube, flow housing, annular space, and isolation valve housing, and the flow housing, the annular space, and the isolation valve housing all being annular, the method comprising:

running in an assembly of screens isolated by at least one packer with at least one auxiliary conduit extending into adjacent zones defined by said packer when said packer is subsequently set; and closing flow in said conduit to prevent flow into shunt tubes during production based on creating a flow barrier that expands radially in the annular space, the flow housing, or the isolation valve housing, the shunt tubes supplying slurry through the auxiliary conduit prior to the production.

2. The method of claim 1, further comprising:

using a closure in the annular space, the flow housing, or the isolation valve housing that changes shape at a predetermined temperature to close said conduit.

3. The method of claim 1, further comprising:

using a conduit wall material that changes shape at a predetermined temperature to close the annular space, the flow housing, or the isolation valve housing.

4. The method of claim 1, further comprising:

running said conduit through a body or a seal of said packer.

5. The method of claim 1, further comprising:

using a shape memory polymer or alloy as part of the annular space, the flow housing, or the isolation valve housing for selective closure of said conduit.

6. The method of claim 5, further comprising:

raising the temperature of said polymer or alloy above the critical temperature for a shape change that results in closure of said conduit.

7. The method of claim 6, further comprising:

adding or removing heat from well fluids in said zones to control the timing of said shape change.

8. The method of claim 1, wherein the closing the flow in said conduit includes disposing an inflatable packer in the annular space to achieve the creating the flow barrier.

9. The method of claim 8, wherein the disposing the inflatable packer includes forming a communication mandrel comprising an inner concentric pipe defining the annular space with a portion comprised of the inflatable packer.

* * * * *